US006924775B2

(12) United States Patent
Suga

(10) Patent No.: US 6,924,775 B2
(45) Date of Patent: Aug. 2, 2005

(54) FEED HORN OF CONVERTER FOR SATELLITE COMMUNICATION RECEPTION, FABRICATION METHOD OF SUCH FEED HORN, AND SATELLITE COMMUNICATION RECEPTION CONVERTER

(75) Inventor: Hiroyuki Suga, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 4 days.

(21) Appl. No.: 10/405,345

(22) Filed: Apr. 3, 2003

(65) Prior Publication Data

US 2003/0222828 A1 Dec. 4, 2003

(30) Foreign Application Priority Data

May 30, 2002 (JP) ..... P 2002-157515

(51) Int. Cl.[7] ..... H01Q 13/00
(52) U.S. Cl. ..... 343/786
(58) Field of Search ..... 343/786, 753, 343/755, 767, 771

(56) References Cited

U.S. PATENT DOCUMENTS

| | | | | |
|---|---|---|---|---|
| 4,141,015 A | | 2/1979 | Wong et al. | 343/786 |
| 5,117,240 A | | 5/1992 | Anderson et al. | 343/786 |
| 5,742,256 A | * | 4/1998 | Wakabayashi | 343/718 |
| 6,023,246 A | * | 2/2000 | Tanabe | 343/753 |
| 6,137,450 A | * | 10/2000 | Bhattacharyya et al. | 343/786 |
| 6,160,520 A | * | 12/2000 | Muhlhauser et al. | 343/755 |
| 6,181,293 B1 | * | 1/2001 | Muhlhauser et al. | 343/840 |
| 6,198,449 B1 | * | 3/2001 | Muhlhauser et al. | 343/753 |
| 6,344,830 B1 | * | 2/2002 | Taylor | 343/767 |
| 6,593,893 B2 | * | 7/2003 | Hou et al. | 343/786 |

FOREIGN PATENT DOCUMENTS

| | | |
|---|---|---|
| GB | 2 270 421 A | 3/1994 |
| GB | 2 383 690 A | 7/2003 |
| JP | 62-23603 A | 1/1987 |

* cited by examiner

*Primary Examiner*—Don Wong
*Assistant Examiner*—Huedung X. Cao
(74) *Attorney, Agent, or Firm*—Birch, Stewart, Kolasch & Birch, LLP

(57) ABSTRACT

A tubular resin member constituting the frame of a feed horn is divided into an inner side resin member located at an inner circumferential plane side and an outer side resin member located at an outer circumferential plane side. The inner side resin member is formed of a resin material that allows metal plating. Metal plating is applied on the inner circumferential plane of the inner side resin member to form a metal plate layer corresponding to a waveguide plane. The outer side resin member is formed of a resin material containing a coating composition to improve the aesthetic appearance. Accordingly, a feed horn of a satellite communication reception converter that can be fabricated readily and economically can be provided.

20 Claims, 9 Drawing Sheets

FEED HORN OF CONVERTER FOR SATELLITE COMMUNICATION RECEPTION, FABRICATION METHOD OF SUCH FEED HORN, AND SATELLITE COMMUNICATION RECEPTION CONVERTER

BACKGROUND OF THE INVENTION

1. Field of the Invention

The present invention relates to a feed horn of a satellite communication reception converter receiving satellite communication waves, a fabrication method thereof, and a converter for satellite communication reception.

2. Description of the Background Art

FIG. 10 is a perspective view of a satellite broadcast receiving antenna. Broadcast waves from a satellite are reflected at a parabolic antenna 50 and enter a feed horn 10 of a satellite broadcast reception converter 1 to be guided through feed horn 10. The guided satellite broadcast waves are applied to a converter circuit arranged in satellite broadcast reception converter 1 to be converted into television picture signals and audio signals for output to a television set.

FIGS. 11A and 11B are a sectional view and a front view, respectively, of a conventional satellite broadcast reception converter. Referring to FIGS. 11A and 11B, satellite broadcast reception converter 1 includes shield cases 2 and 3 to protect internal components. Converter 1 has a printed circuit board 4 attached therein. A converter circuit converting satellite broadcast waves into electric signals is implemented on printed circuit board 4. A feed horn 10 receiving satellite broadcast waves is attached to the outer side of shield case 2. An F type attachment 8 to output an electric signal towards a television set is provided at a predetermined region of shield cases 2 and 3 so as to protrude outwards.

Feed horn 10 is formed of a tubular member having a transmission path configured therein through which satellite broadcast waves are guided. At the satellite broadcast wave input side of feed horn 10, a horn cap 7 to maintain a sealed interior is attached. This horn cap 7 is formed of a material other than a conductor so as to pass through at least satellite broadcast waves.

The other end side of feed horn 10 is coupled to printed circuit board 4 mounted in shield cases 2 and 3. As shown in FIG. 11B, probes 5 and 6 corresponding to the antenna unit are provided at a region of printed circuit board 4 facing the transmission path of feed horn 10.

According to the above structure, satellite broadcast waves entering feed horn 10 through horn cap 7 are guided through feed horn 10 to arrive at probes 5 and 6 located at printed circuit board 4. The satellite broadcast waves received by probes 5 and 6 are converted into television picture signals and audio signals by the converter circuit provided on printed circuit board 4 and output towards a television set via F type attachment 8.

It is appreciated from the drawings that feed horn 10 of the satellite broadcast reception converter of the above structure is attached to shield cases 2 and 3 with the outer circumferential plane exposed. From the aesthetical standpoint, the outer circumferential plane of feed horn 10 must be configured with an ornamental plane to improve the appearance. The inner circumferential plane of feed horn 10 must allow the satellite broadcast wave arriving at the transmission path in feed horn 10 through horn cap 7 to be transmitted to probes 5 and 6 provided at printed circuit board 4 without any loss. This means that the inner circumferential plane of feed horn 10 must have a waveguide plane formed of, for example, a conductor, provided thereon.

FIG. 12 shows a sectional view of a conventional feed horn of a converter for satellite broadcast reception. Referring to FIG. 12, a conventional feed horn 10E has its frame formed of a resin member 11. In order to comply with the above-described requirements, a metal plate layer 12 corresponding to a waveguide plane is formed on the inner circumferential plane of resin member 11. On the outer circumferential plane of resin member 11, a coating layer 13 which is the ornamental plane is disposed.

Feed horn 10E with a metal plate layer 12 on the inner circumferential plane and a coating layer 13 on the outer circumferential plane is fabricated as set forth below. First, as shown in FIG. 13, a tubular resin member 11 corresponding to the frame of feed horn 10E is formed by injection molding. Then, metal plating is applied all over resin member 11. Accordingly, the entire surface of resin member 11 is covered with a metal plate layer 12, as shown in FIG. 14. Then, the inner circumferential plane of resin member 11 covered with metal plate layer 12 is masked, followed by coating via a spray gun. Accordingly, a coating layer 13 is selectively formed only at the outer circumferential plane of resin member 11 that was not masked. The mask is then removed, resulting in feed horn 10 of the structure shown in FIG. 12.

For the resin member, an acrylo nitrile-butadiene-styrene (ABS) resin, for example, is employed to allow metal plating. For the coating composition, acrylic based coating is employed.

The above-described fabrication method of a feed horn for a satellite broadcast reception converter is disadvantageous in that the fabrication process is complicated due to the requirement of masking in the coating step, resulting in increase of the fabrication cost. Furthermore, the resin material that can be used to form the resin member was limited to resin materials that allow metal plating. There was a problem that the selection range of materials is small.

SUMMARY OF THE INVENTION

An object of the present invention is to provide a feed horn of a satellite communication reception converter, allowing a wider range of material selection as well as simple and economic fabrication, a fabrication method of such a feed horn, and a broadcast communication reception converter including such a feed horn.

According to an aspect of the present invention, a feed horn of a satellite communication reception converter is configured with a tubular member formed of a resin material, having a waveguide plane guiding an input wave formed on an inner circumferential plane, and an ornamental plane constituting an outer circumferential plane. The tubular member is divided into an inner side resin member located at the inner circumferential plane side, and an outer side resin member located at an outer circumferential plane side.

By forming the resin member constituting the frame of a feed horn into divisions of an inner side resin member and an outer side resin member, as compared to a conventional integrally formed feed horn, the inner circumferential plane and outer circumferential plane can be formed of resin materials that meet the characteristics required for respective circumferential planes. Specifically, the inner side resin member constituting the inner circumferential plane where the waveguide plane is to be located can be formed using a resin material that facilitates formation of a waveguide plane. The outer side resin member constituting the outer circumferential plane corresponding to an ornamental plane can be formed using a resin material that improves the aesthetic appearance and a resin material particularly superior in weatherability. By virtue of the increase of the material selection range, various advantages can be expected such as lowering the fabrication cost and improving reliability.

Preferably in the feed horn of a satellite communication reception converter of the present invention, the inner side resin member is formed of a resin material that allows metal plating and, a waveguide plane is formed by applying metal plating on the inner circumferential plane of the inner side resin member.

By forming the inner side resin member using a resin material that allows metal plating as in the present structure, a waveguide plane can be readily formed on the inner circumferential plane by metal plating.

According to the feed horn of a satellite communication reception converter of the present invention, the inner side resin member is preferably formed of a resin material selected from the group consisting of acrylo nitrile-butadiene-styrene resin, syndiotactic polystyrene resin and plating grade setting resin.

As a resin material that allows metal plating employed for the inner side resin member, the above-described resin, for example, can be used.

According to a feed horn of a satellite communication reception converter of the present invention, the outer side resin member is preferably formed of a resin material containing a coating composition.

By forming the outer side resin member with a resin material containing coating compositions, a feed horn having an ornamental plane of a desired color can be formed without the conventionally-required coating step through masking. Therefore, the fabrication process is simplified, and the fabrication cost can be reduced.

According to the feed horn of a satellite communication reception converter of the present invention, the outer side resin member is preferably formed of a resin material that disallows metal plating.

By forming the outer side resin member with a resin material that disallows metal plating, metal plating can be applied selectively only at an exposed surface of the inner side resin member after the outer side resin member is formed so as to cover the outer circumferential plane of the inner side resin member. Since the outer side resin member can be formed prior to the metal plating process according to the present structure, the degree of freedom in the fabrication process is increased significantly.

According to the feed horn of a satellite communication reception converter of the present invention, the outer side resin member is preferably formed of a resin material selected from the group consisting of polypropylene resin, polyacetal resin and polycarbonate resin.

As a resin material that disallows metal plating, employed for the inner side resin member, the above cited resin can be employed.

Preferably in the feed horn of a satellite communication reception converter of the present invention, one of the inner side resin member and outer side resin member is provided with a convex, and the other of the inner side resin member and outer side resin member is provided with a concave at a coupling plane therebetween. The convex and concave are fitted together.

By fitting the convex and concave of the inner side resin member and outer side resin member at the coupling region, the inner side resin member and the outer side resin member are fixed to prevent rotation with respect to each other.

According to an aspect of the present invention, a satellite communication reception converter includes a converter circuit converting a satellite communication wave into an electric signal, and a feed horn receiving and transmitting the satellite communication wave to the converter circuit. The feed horn is configured with a tubular member formed of a resin member having a waveguide plane guiding an input satellite communication wave formed on an inner circumferential plane, and an ornamental plane constituting an outer circumferential plane. The tubular member is divided into an inner side resin member located at the inner circumferential plane side and an outer side resin member located at the outer circumferential plane side.

Preferably in the satellite communication converter of the present invention, the inner side resin member is formed of a resin material that allows metal plating, whereas the outer side resin member is formed of a resin material containing a coating composition and that disallows metal plating. The waveguide plane is formed by applying metal plating on the inner circumferential plane of the inner side resin member.

A satellite communication reception converter of the above-described structure can be fabricated economically and readily.

According to an aspect of the present invention, a fabrication method of a feed horn of a satellite communication reception converter configured with a tubular member formed of a resin material having a waveguide guiding an input wave formed on an inner circumferential plane and an ornamental plane constituting an outer circumferential plane, includes the steps of:

a) forming an inner side resin member constituting the inner circumferential plane side of the tubular member by injection molding using a resin material that allows metal plating;

b) applying metal plating on a surface of the inner side resin member; and c) forming the outer side resin member constituting the outer circumferential plane side of the tubular member by injection molding so as to cover the outer circumferential plane of the inner side resin member applied with metal plating.

By forming the inner side resin member with a resin material that allows metal plating, applying metal plating on the surface of the inner side resin member, and forming the outer side resin member constituting an ornamental plane so as to cover the outer circumferential plane as in the present fabrication method, the conventionally-required coating step employing masking is dispensable. Therefore, a feed horn of a satellite communication reception converter can be fabricated readily and economically.

According to another aspect of the present invention, a fabrication method of a feed horn of a satellite communication reception converter configured with a tubular member formed of a resin material having a waveguide guiding an input wave formed on an inner circumferential plane and an ornamental plane constituting an outer circumferential plane, includes the steps of:

a) forming an inner side resin member constituting the inner circumferential plane side of the tubular member by injection molding using a resin material that allows metal plating;

b) forming the outer side resin member constituting the outer circumferential plane side of the tubular member by injection molding with a resin material that disallows metal plating so as to cover the outer circumferential plane of the inner side resin material; and c) selectively applying metal plating only on an exposed surface of the inner side resin member among the tubular member.

By forming the inner side resin member with a resin material that allows metal plating and forming the outer side resin member with a resin material that disallows metal plating so as to cover the outer circumferential plane of the inner side resin member, a metal plating process can be conducted after formation of the outer side resin member. Accordingly, the conventionally-required coating step employing masking is dispensable, and the degree of freedom in the fabrication process can be increased. A feed horn of a satellite communication reception converter can be fabricated readily and economically.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described hereinafter with reference to the drawings.

First Embodiment

The feed horn according to a first embodiment of the present invention is a feed horn employed in a satellite broadcast reception converter of a configuration already described in the conventional art. Description of a satellite broadcast reception converter will not be repeated here.

Figure 1:
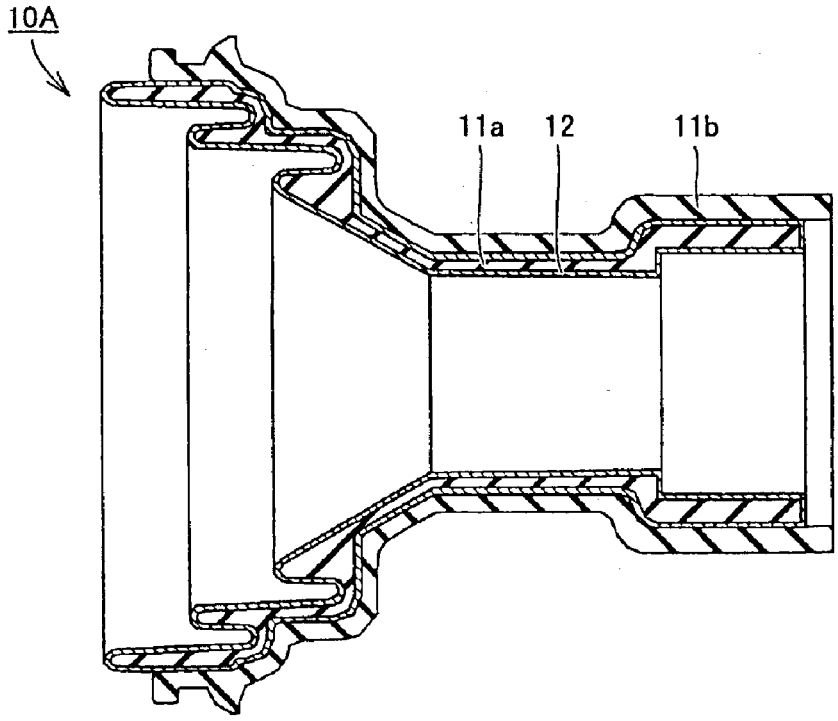
FIG. 1 is a sectional view of a feed horn according to a first embodiment of the present invention.

Referring to FIG. 1, the frame of a feed horn 10A of a satellite broadcast reception converter of the first embodiment includes an inner side resin member 11*a* located at an inner circumferential plane side, and an outer side resin member 11*b* located at an outer circumferential plane side. Inner side resin member 11*a* has its entire surface covered with a metal plate layer 12. The outer side of metal plate layer 12 covering the outer circumferential plane of inner side resin member 11 is covered with outer side resin member 11*b*.

Inner side resin member 11*a* is formed of a resin material that allows metal plating. For example, acrylo nitrile-butadiene-styrene (ABS) resin, syndiotactic polystyrene (SPS) resin, plate grade setting resin, and the like can be employed. Outer side resin member 11*b* is formed of a resin material capable of maintaining aesthetic appearance. For example, a glossy resin material, a resin material containing coating compositions, and the like can be employed. Since a satellite broadcast reception converter is generally installed outdoors, a resin material superior in weatherability is preferably employed.

Figure 2:
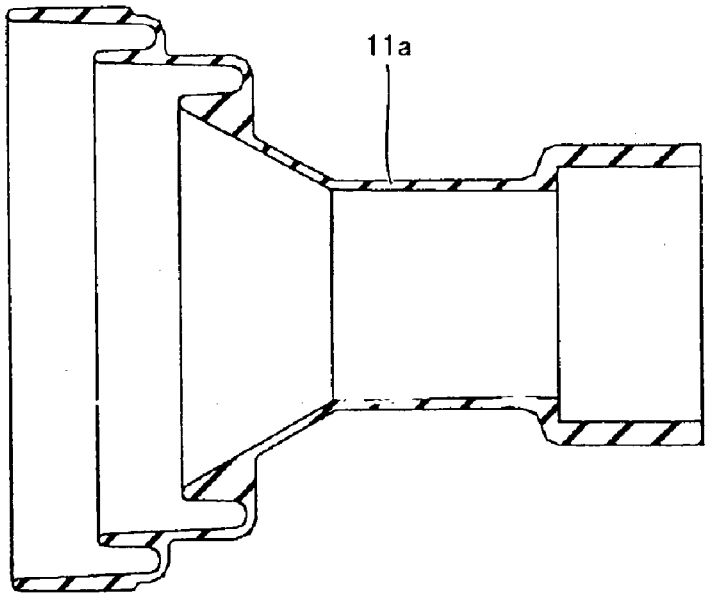
FIGS. 2 and 3 show fabrication steps of the feed horn of the first embodiment.
Figure 3:
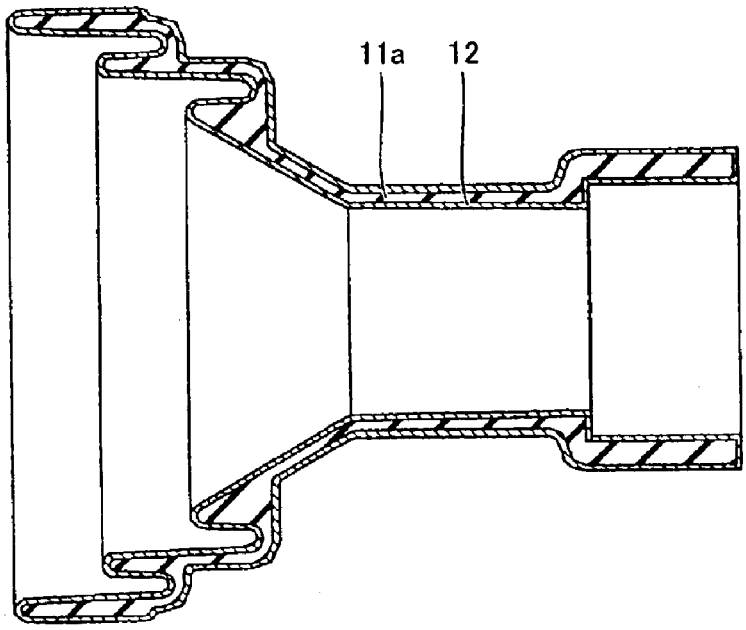

A method of fabricating the feed horn of the above structure will be described with reference to FIGS. 2 and 3. As shown in FIG. 2, a tubular inner side resin member 11*a* corresponding to the frame of feed horn 10A is formed by injection molding. Then, the entire surface of inner side resin member 11*a* is subjected to metal plating. Accordingly, the surface of inner side resin member 11*a* is covered with metal plating layer 12, as shown in FIG. 3. Inner side resin member 11*a* covered with metal plate layer 12 is set in, for example, a double injection molding machine to form outer side resin member 11*b* by injection molding so that the outer circumferential plane is covered. As a result, feed horn 10A of FIG. 1 is obtained.

By fabricating a feed horn of a satellite broadcast reception converter through the above-described fabrication steps, a feed horn having a waveguide plane formed on the inner circumferential plane and an ornamental plane constituting the outer circumferential plane can be fabricated readily without the conventionally-required coating step employing masking. This renders the process simple. A feed horn for a satellite broadcast reception converter can be fabricated economically.

By the fabrication of the resin member divided into an inner side resin member and an outer side resin member, a resin material that facilitates formation of a waveguide plane can be employed for the inner side resin member, whereas a resin material more suitable for formation of an ornamental plane and superior in weatherability can be employed for the outer side resin member. Accordingly, a resin material can be appropriately selected according to its usage.

Second Embodiment

A feed horn according to a second embodiment of the present invention is employed in a satellite broadcast reception converter of a structure described in the conventional art, likewise the above-described first embodiment.

Figure 4:
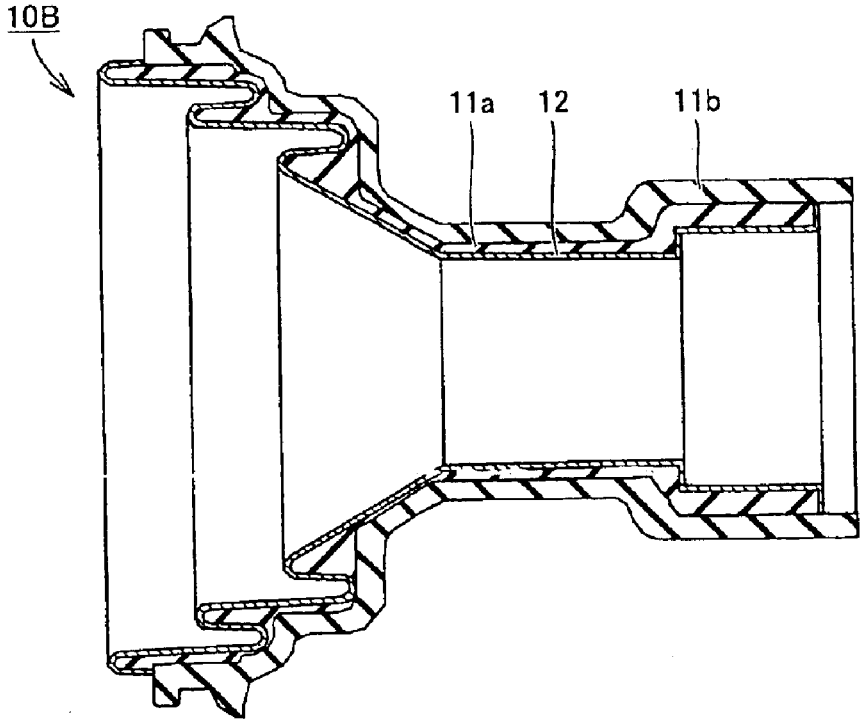
FIG. 4 is a sectional view of a feed horn according to a second embodiment of the present invention.

Referring to FIG. 4, the frame of a feed horn 10B of a satellite broadcast reception converter according to a second embodiment of the present invention includes an inner side resin member 11*a* located at the inner circumferential plane side, and an outer side resin member 11*b* located at the outer circumferential plane side. The inner circumferential plane of inner side resin member 11*a* is covered with metal plate layer 12. The outer circumferential plane of inner side resin member 11*a* is covered with outer side resin member 11*b*.

Inner side resin material 11*a* is formed of a resin material that allows metal plating. For example, acrylo nitrile-butadiene-styrene (ABS) resin, syndiotactic polystyrene (SPS) resin, plate grade setting resin, and the like can be employed. Outer side resin member 11*b* is formed of a resin material that disallows metal plating. For example, polypropylene (PP) resin, polyacetal (POM) resin, polycarbonate (PC) resin, and the like can be employed.

Preferably, the outer side resin member 11*b* is formed of a resin material capable of maintaining an aesthetic appearance. For example, a glossy resin material, or a resin material containing coating compositions can be used. Since a satellite broadcast reception converter is generally installed outdoors, a resin material superior in weatherability is preferably employed.

Figure 5:
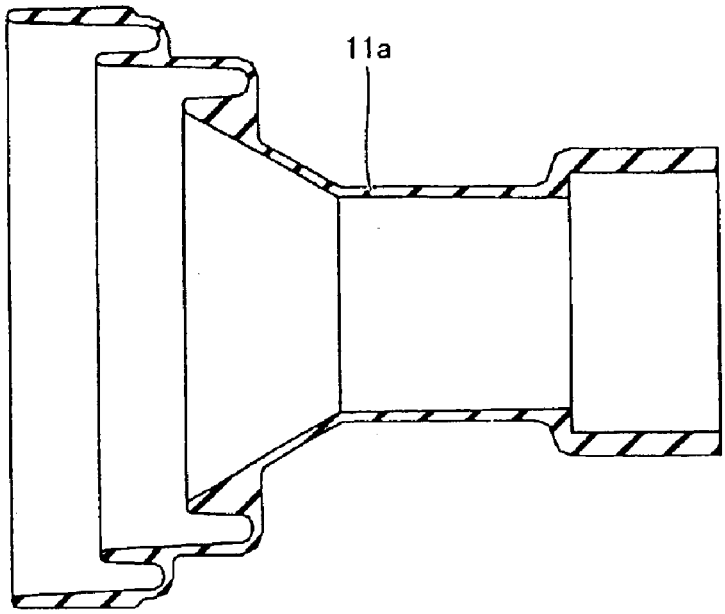
FIGS. 5 and 6 show fabrication steps of the feed horn of the second embodiment.
Figure 6:
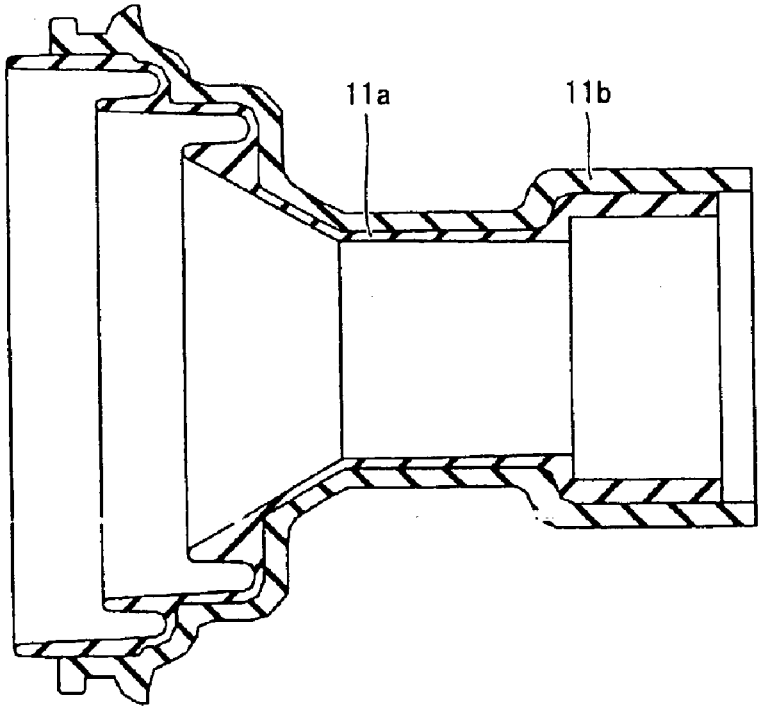

A method of fabricating a feed horn of the above-described structure will be described with reference to FIGS. 5 and 6. Referring to FIG. 5, a tubular inner side resin member 11*a* corresponding to the frame of feed horn 10B is formed by injection molding. Then, inner side resin member 11*a* is set in a double injection molding machine, for example, to form outer side resin member 11*b* by injection molding so that the outer circumferential plane of inner side resin material 11*a* is covered. Accordingly, a resin member of the structure shown in FIG. 6 is provided. Then, the entire surface of resin member 11 is subjected to metal plating. Since outer side resin member 11*b* is formed of a resin material that disallows metal plating, metal plate layer 12 is selectively formed only on the exposed plane of inner side resin member 11*a*. Accordingly, feed horn 10B of the structure shown in FIG. 4 is obtained.

By fabricating a feed horn of a satellite broadcast reception converter through the above-described fabrication steps, a feed horn having a waveguide plane formed on the inner circumferential plane and an ornamental plane constituting the outer circumferential plane can be fabricated readily without the conventionally-required coating step employing masking. The degree of freedom in the fabrication process is increased, so that further reduction in the fabrication cost can be expected.

Figure 7:
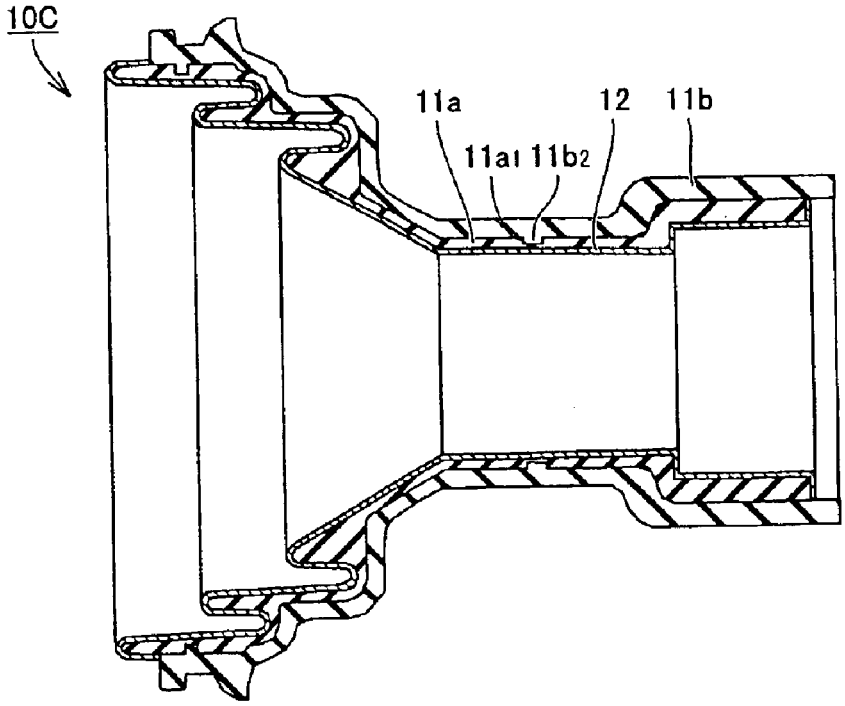
FIGS. 7 and 8 are sectional views of a feed horn corresponding to modifications of the second embodiment.
Figure 8:
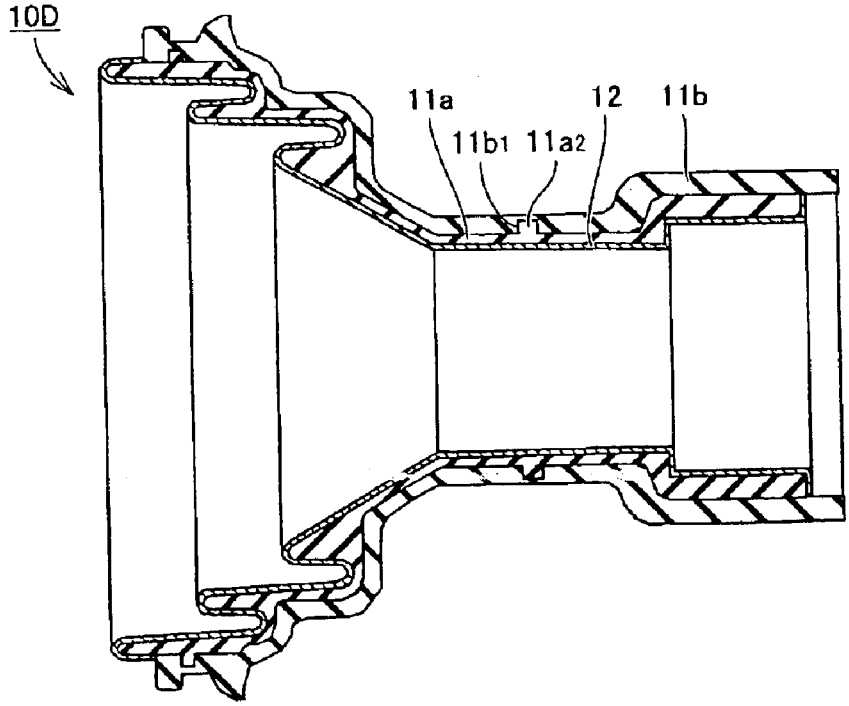

In the above first and second embodiments, an outer side resin member is outsert-molded at the outer circumferential plane of the inner side resin member. The outer side resin member may rotate with respect to the inner side resin member since no fixation means is generally provided therebetween. To prevent such rotation, one of inner side resin member 11*a* and outer side resin member 11*b* may have a convex provided and the other of inner side resin member 11*a* and outer side resin member 11*b* may have a convex provided at the coupling region to fit together, as shown in FIGS. 7 and 8. FIG. 7 shows a feed horn 10C having a concave 11*a*1 provided at inner side resin member 11*a* and a convex 11*b*2 provided at outer side resin member 11*b*. FIG. 8 shows a feed horn 10D having a convex 11*a*2 provided at inner side resin member 11*a* and a concave 11*b*1 provided at outer side resin member 11*b*.

Third Embodiment

A satellite broadcast reception converter according to a third embodiment of the present invention is an apparatus mounted to a satellite broadcast receiving parabolic antenna to receive a satellite broadcast wave reflected by the parabolic antenna.

The satellite broadcast wave reflected at the parabolic antenna enters a feed horn of the satellite broadcast reception converter to be guided through the feed horn. The guided satellite broadcast wave is applied to a converter circuit disposed in the satellite broadcast reception converter to be converted into a television picture signal or audio signal for output to a television set.

Figure 9:
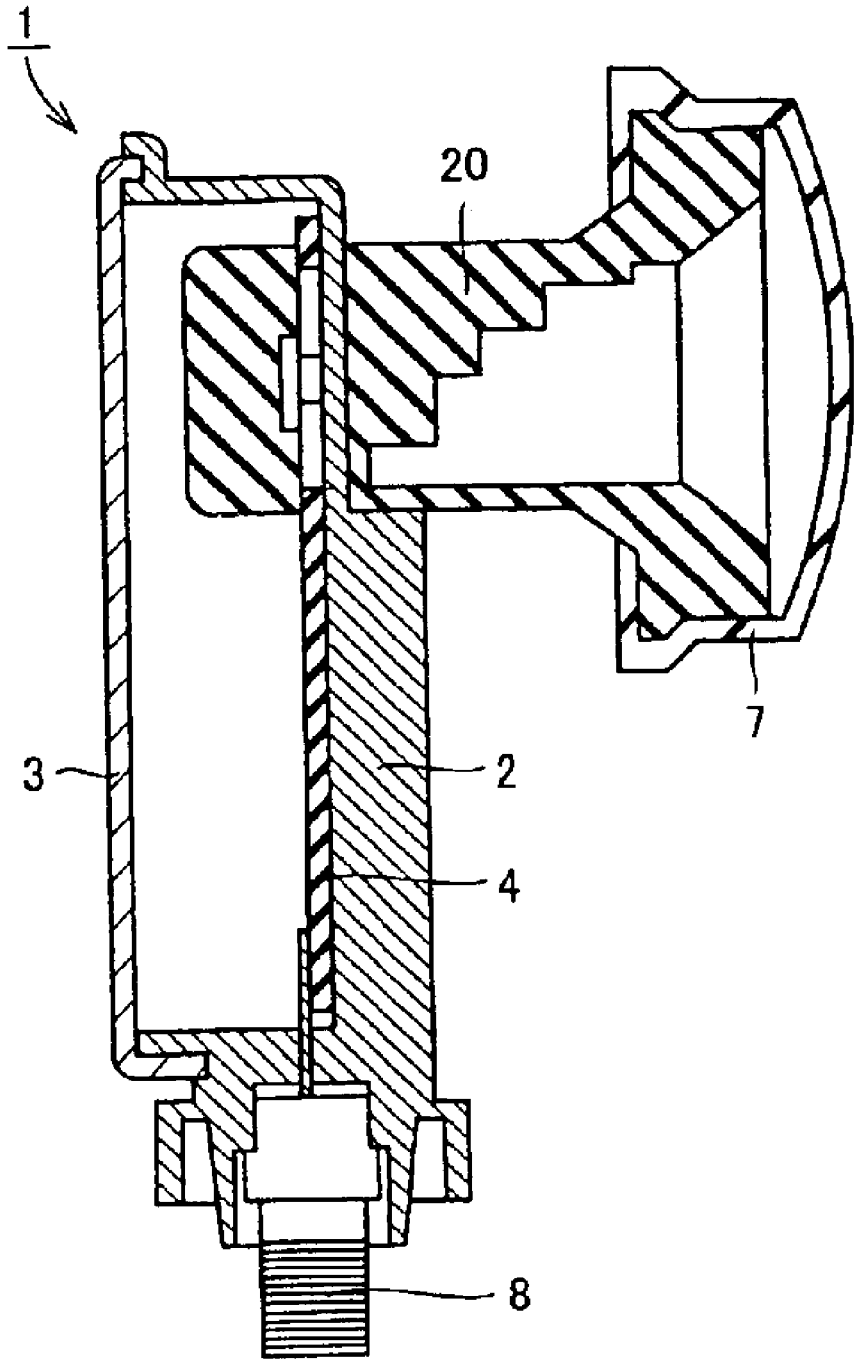
FIG. 9 is a sectional view of a satellite broadcast reception converter according to a third embodiment of the present invention.
Figure 10:
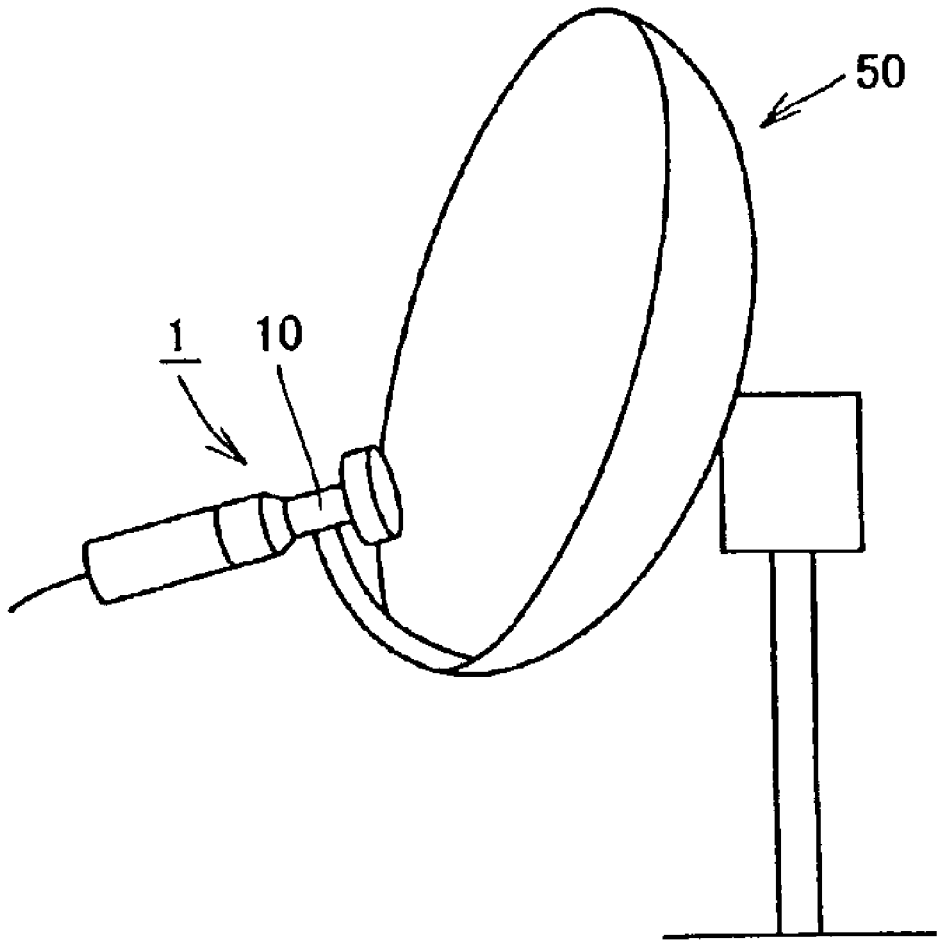
FIG.10 PRIOR ART
FIG. 10 is a perspective view of a structure of a general satellite broadcast receiving antenna.
Figure 11B:
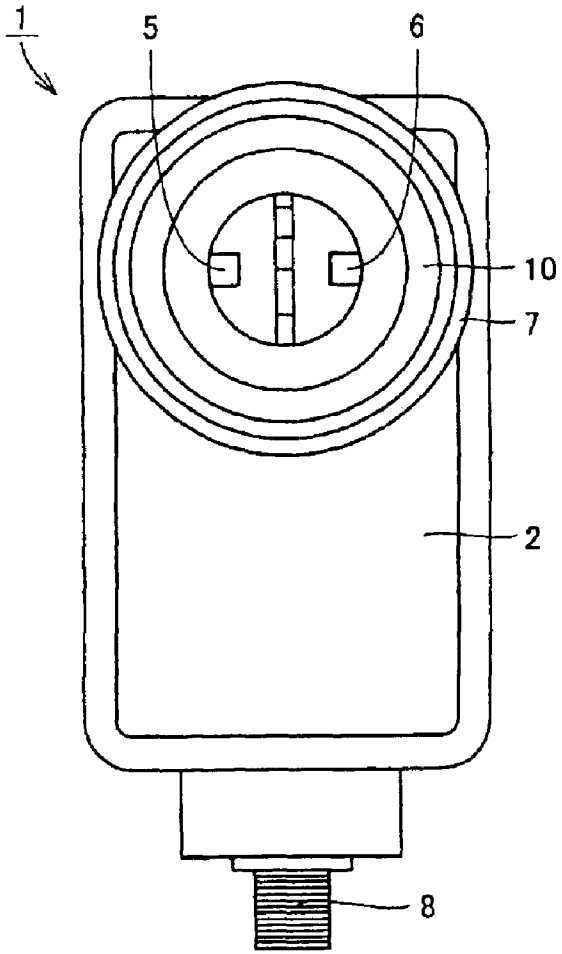
FIG.11B PRIOR ART
FIGS. 11A and 11B are a sectional view and a front view, respectively, of a structure of a general satellite broadcast reception converter.
Figure 11A:
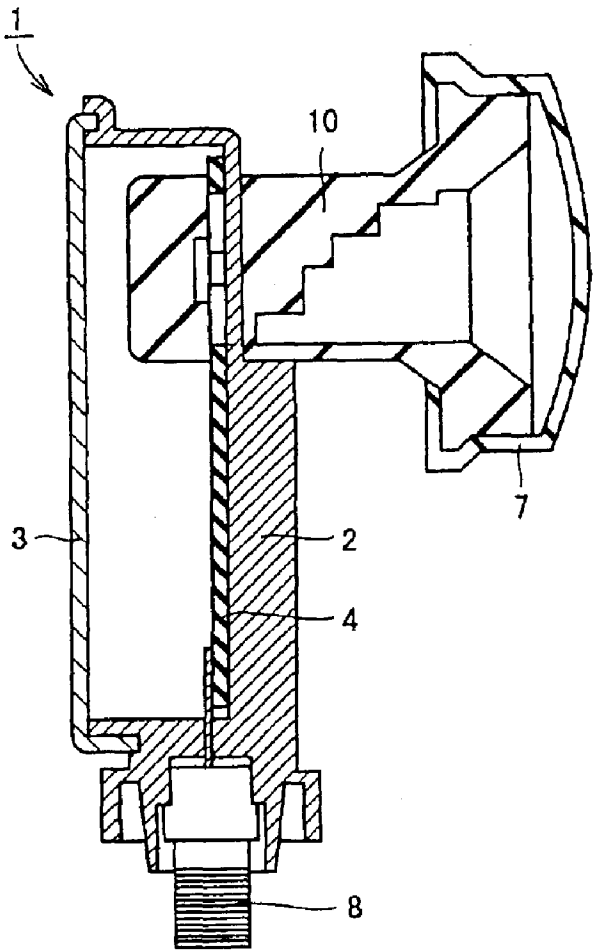
FIG.11A PRIOR ART
Figure 12:
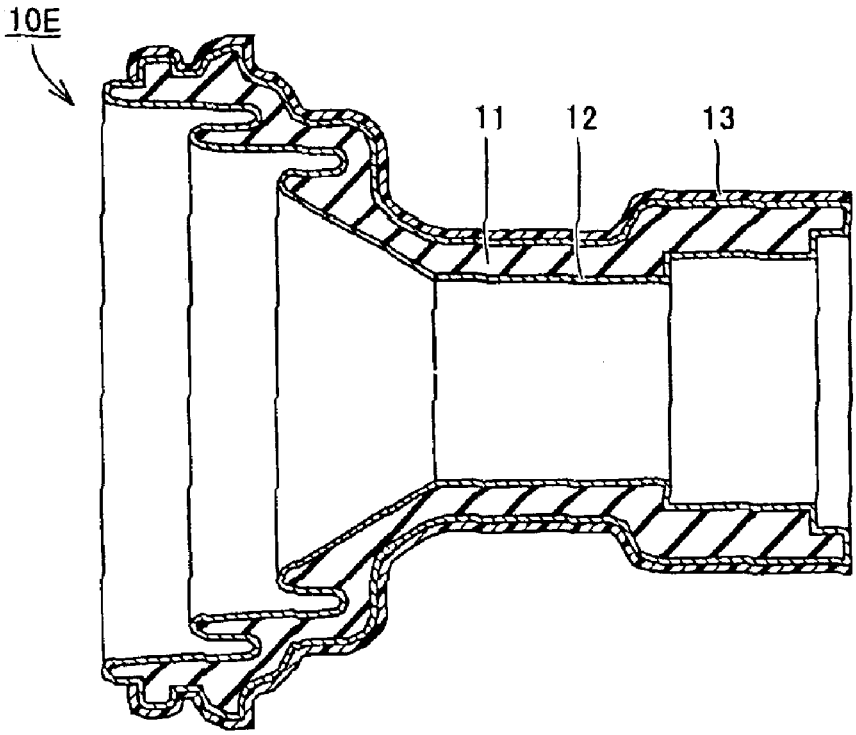
FIG.12 PRIOR ART
FIG. 12 is a sectional view of conventional feed horn.
Figure 13:
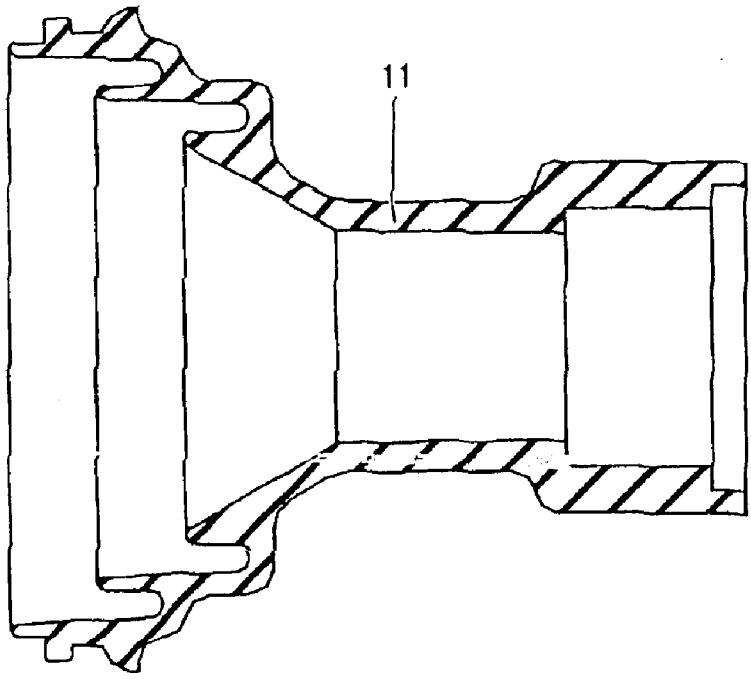
FIG.13 PRIOR ART
FIGS. 13 and 14 are sectional views of fabrication steps of a conventional feed horn.
Figure 14:
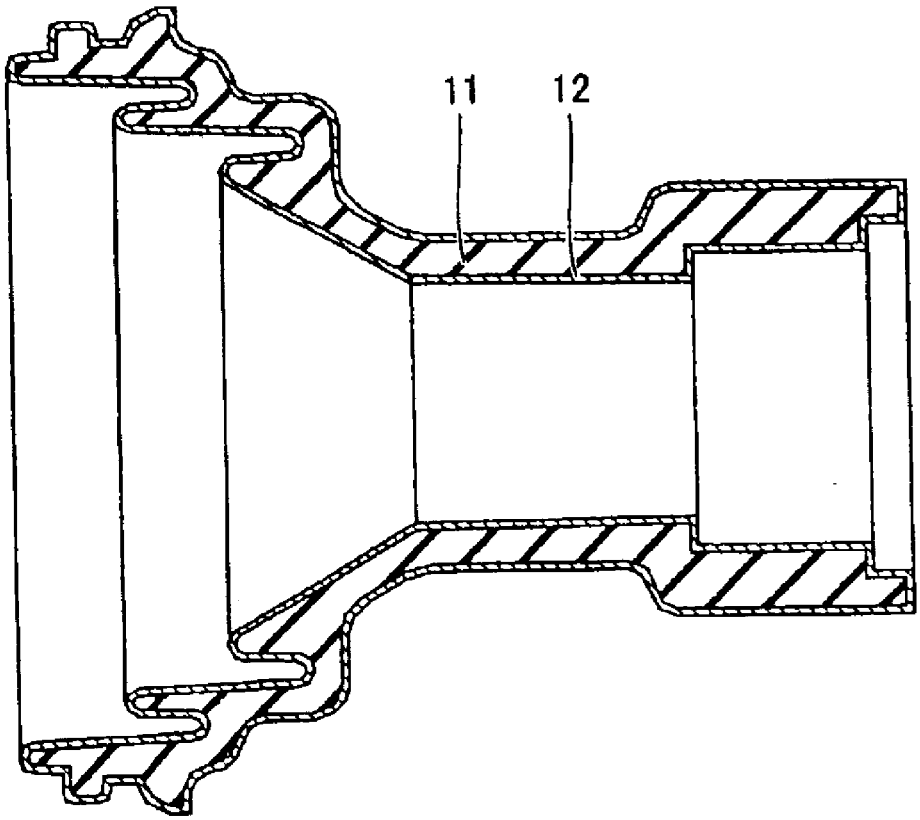
FIG.14 PRIOR ART

Referring to FIG. 9, a satellite broadcast reception converter 1 includes shield cases 2 and 3 to protect inner components. A printed circuit board 4 having a converter circuit converting a satellite broadcast wave into an electric signal is attached in shield cases 2 and 3. A feed horn 20 receiving a satellite broadcast wave is attached to the outer side of shield case 2. An F type attachment 8 to output an electric signal towards a television set is provided at a predetermined region of shield cases 2 and 3 in a protruding manner. As feed horn 20, feed horns 10A–10D of the above-described first or second embodiment is employed.

By the above-described structure, a satellite communication reception converter can be fabricated economically and readily.

The above description is based on a feed horn having a waveguide portion and horn portion formed integrally. The feed horn of the present invention is not limited thereto, and a feed horn having the waveguide portion and the horn portion formed individually can be employed. The feed horn of the present invention has a structure including both a waveguide portion and horn portion, including only a waveguide portion, or only a horn portion. The present invention is also applicable to a structure that includes only such a waveguide portion or horn portion.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A feed horn of a satellite communication reception converter comprising a first tubular resin member formed from a first resin and having a waveguide plane guiding an input wave formed on an inner circumferential plane of said first tubular resin member, and an ornamental plane comprising a second resin member formed from a second resin on an outer circumferential plane of said first resin member.

2. The feed horn of a satellite communication reception converter according to claim 1, wherein said first resin allows metal plating, and said waveguide plane is formed by applying metal plating on the inner circumferential plane of said first tubular resin member.

3. The feed horn of a satellite communication reception converter according to claim 2, wherein said first resin comprises a material selected from the group consisting of acrylo nitrile-butadiene-styrene resin, syndiotactic polystyrene resin, and plated grade setting resin.

4. The feed horn of a satellite communication reception converter according to claim 1, wherein said second resin comprises a material containing a coating composition.

5. The feed horn of a satellite communication reception converter according to claim 1, wherein said second resin disallows metal plating.

6. The feed horn of a satellite communication reception converter according to claim 5, wherein said second resin comprises a material selected from the group consisting of polypropylene resin, polyacetal resin, and polycarbonate resin.

7. The feed horn of a satellite communication reception converter according to claim 1, wherein one of said first resin member and said second resin member has a convex portion and the other of said inner side resin member and said outer side resin member has a concave portion at a coupling plane of said first resin member and said second resin member, and said concave portion and said convex portion are fitted together.

8. A satellite communication reception converter including a converter circuit converting a satellite communication wave into an electric signal, and a feed horn receiving and transmitting a satellite communication wave to said converter circuit, wherein said feed horn comprises a first tubular resin member formed of a first resin material and having a waveguide plane guiding an input satellite communication wave formed on an inner circumferential plane of the first resin member, and an ornamental plane comprising a second resin member formed of a second resin material on an outer circumferential plane of said first resin member.

9. The satellite communication reception converter according to claim 8, wherein said first resin allows metal plating, said second resin contains a coating composition and disallows metal plating, and said waveguide plane is formed by applying metal plating on the inner circumferential plane of said first resin member.

10. A fabrication method of a feed horn of a satellite communication reception converter, configured with a tubular member formed of a resin material, having a waveguide plane guiding an input electric wave formed on an inner circumferential plane, and an ornamental plane constituting an outer circumferential plane, said fabrication method comprising the steps of:

forming an inner side resin member constituting an inner circumferential plane side of said tubular member by injection molding with a resin material that allows metal plating, applying metal plating on a surface of said inner side resin member, and forming an outer side resin member constituting an outer circumferential plane side of said tubular member by injection molding so as to cover an outer circumferential plane of the inner side resin member applied with said metal plating.

11. A fabrication method of a feed horn of a satellite communication reception converter configured with a tubular member formed of a resin material, having a waveguide plane guiding an input wave formed on an inner circumferential plane, and an ornamental plane constituting an outer circumferential plane, said fabrication method comprising the steps of:

forming an inner side resin member constituting an inner circumferential plane side of said tubular member by injection molding with a resin material that allows metal plating, forming an outer side resin member constituting an outer circumferential plane side of said tubular member by injection molding with a resin material that disallows metal plating so as to cover an outer circumferential plane of said inner side resin member, and selectively applying metal plating only at an exposed surface of said inner side resin member among said tubular member.

12. A feed horn of a satellite communication reception converter comprising:

a first resin member formed from a first resin having an inner side and an outer side;

a waveguide for guiding an input wave formed on said inner side; and a second resin member formed from a second resin overlying said outer side.

13. The feed horn of claim 12 wherein said second resin member is formed on said first resin member.

14. The feed horn of claim 12 wherein said first resin member comprises a first resin and said second resin member comprises a second resin different from said first resin.

15. The feed horn of claim 14 wherein said first resin is metal platable.

16. The feed horn of claim 15 wherein said second resin is not metal platable.

17. The feed horn of claim 15 wherein said first resin is selected from the group consisting of acrylo nitrile-butadiene-styrene resin, syndiotactic polystyrene resin, and plated grade setting resin.

18. The feed horn of claim 15 wherein said second resin is selected from the group consisting of polypropylene resin, polyacetal resin, and polycarbonate resin.

19. The feed horn of a satellite communication reception converter according to claim 1, wherein said second resin comprises a glossy resin material.

20. The feed horn of claim 12 wherein said waveguide completely covers said first resin member inner side.

* * * * *